US008081899B2

(12) United States Patent
Ito

(10) Patent No.: US 8,081,899 B2
(45) Date of Patent: Dec. 20, 2011

(54) IMAGE FORMING APPARATUS HAVING CONTACTING MEMBERS FOR CONTACTING EACH OTHER RESPONSIVE TO AN EXTERNAL FORCE WHEN AN OPENING/CLOSING MEMBER IS IN CLOSED POSITION

(75) Inventor: Sakae Ito, Kitanagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 825 days.

(21) Appl. No.: 11/959,927

(22) Filed: Dec. 19, 2007

(65) Prior Publication Data

US 2008/0145098 A1 Jun. 19, 2008

(30) Foreign Application Priority Data

Dec. 19, 2006 (JP) ..... 2006-341506

(51) Int. Cl.
*G03G 21/16* (2006.01)

(52) U.S. Cl. ..... 399/110; 399/107; 399/124; 399/125

(58) Field of Classification Search ..... 399/107, 399/110, 124, 125
See application file for complete search history.

(56) References Cited

U.S. PATENT DOCUMENTS

| | | | |
|---|---|---|---|
| 6,510,301 | B2 | 1/2003 | Tanaka |
| 7,133,626 | B2 | 11/2006 | Kaiga et al. |
| 2006/0083542 | A1 | 4/2006 | Ito |
| 2006/0088336 | A1 | 4/2006 | Hirose et al. |

FOREIGN PATENT DOCUMENTS

| | | | |
|---|---|---|---|
| JP | 60-173955 | | 11/1985 |
| JP | 5-213331 | A | 8/1993 |
| JP | 07-261490 | | 10/1995 |
| JP | 09-054471 | | 2/1997 |
| JP | 09-251222 | | 9/1997 |
| JP | 11-115957 | A | 4/1999 |
| JP | 11-220268 | A | 8/1999 |
| JP | 2001-242563 | A | 9/2001 |
| JP | 2001-281771 | A | 10/2001 |
| JP | 2002-108505 | A | 4/2002 |
| JP | 2005-189551 | A | 7/2005 |
| JP | 2006-119236 | A | 5/2006 |
| JP | 2006-119474 | | 5/2006 |
| JP | 2006-215183 | A | 8/2006 |

OTHER PUBLICATIONS

Decision of Final Rejection Application No. 2006-341506 dated Jun. 18, 2009.

JP Office Action dtd May 11, 2010, JP Appln. 2006-341506, English Translation.

Notice of Reasons of Rejection, Patent Application No. 2006-341506, Docketing No. 2006-02945, Dispatch No. 700883, Mailing Date: Nov. 20, 2008.

*Primary Examiner* — David Gray
*Assistant Examiner* — Andrew Do
(74) *Attorney, Agent, or Firm* — Banner & Witcoff, Ltd.

(57) ABSTRACT

An image forming apparatus configured to prevent damage to an opening/closing member when external force is applied in a direction perpendicular to a direction where a scanner unit is opened or closed with respect to an image forming unit.

18 Claims, 8 Drawing Sheets

IMAGE FORMING APPARATUS HAVING CONTACTING MEMBERS FOR CONTACTING EACH OTHER RESPONSIVE TO AN EXTERNAL FORCE WHEN AN OPENING/CLOSING MEMBER IS IN CLOSED POSITION

CROSS REFERENCE TO RELATED APPLICATION

This application claims priority from Japanese Patent Application No. 2006-341506, filed on Dec. 19, 2006, the entire subject matter of which is incorporated herein by reference.

FIELD

Aspects described herein relate to an image forming apparatus, such as a laser printer.

BACKGROUND

An image forming apparatus such as a laser printer includes a scanner unit for scanning image information on a document and an image forming unit for forming the image information scanned by the scanner unit on a recording sheet. The image forming apparatus includes a copier and a digital multifunction apparatus provided with facsimile/network communication function.

A middle ejection type image forming apparatus is becoming increasingly popular. In the middle ejection type image forming apparatus, a space for ejecting a recording sheet having an image formed thereon is provided between the vertically disposed scanner and image forming units. The footprint of the image forming apparatus can be decreased when the recording sheet is ejected in this manner.

Generally a middle ejection type image forming apparatus has the scanner unit pivotally coupled to the image forming unit via hinge members. Thus, when the middle ejection type image forming apparatus is transported, the scanner unit may become torsionally deformed with respect to the image forming unit.

To prevent such torsional deformation, the middle ejection type image forming apparatus can be loaded on a pallet such that a supporting member disposed on a column of the pallet is interposed between the image forming unit and the scanner unit.

However, if the scanner unit and the image forming unit are displaced horizontally relatively to each other, the supporting member may not prevent displacement, which may lead to damage to the hinge members.

SUMMARY

Aspects of the invention may provide an image forming apparatus configured to prevent damage to an opening/closing member when external force is applied in a direction perpendicular to a direction where a scanner unit is opened or closed with respect to an image forming unit.

BRIEF DESCRIPTION OF THE DRAWINGS

Illustrative aspects of the invention will be described in detail with reference to the following figures in which like elements are labeled with like numbers and in which.

DETAILED DESCRIPTION

An illustrative embodiment of the invention will be described in detail with reference to the accompanying drawings. An image forming apparatus according to aspects of the invention is applied to a laser printer in this embodiment. It will be appreciated that aspects of the invention apply to other types of image forming apparatuses as well.

A general structure of an illustrative laser printer 1 will be described with reference to FIGS. 1-8.

Figure 1:
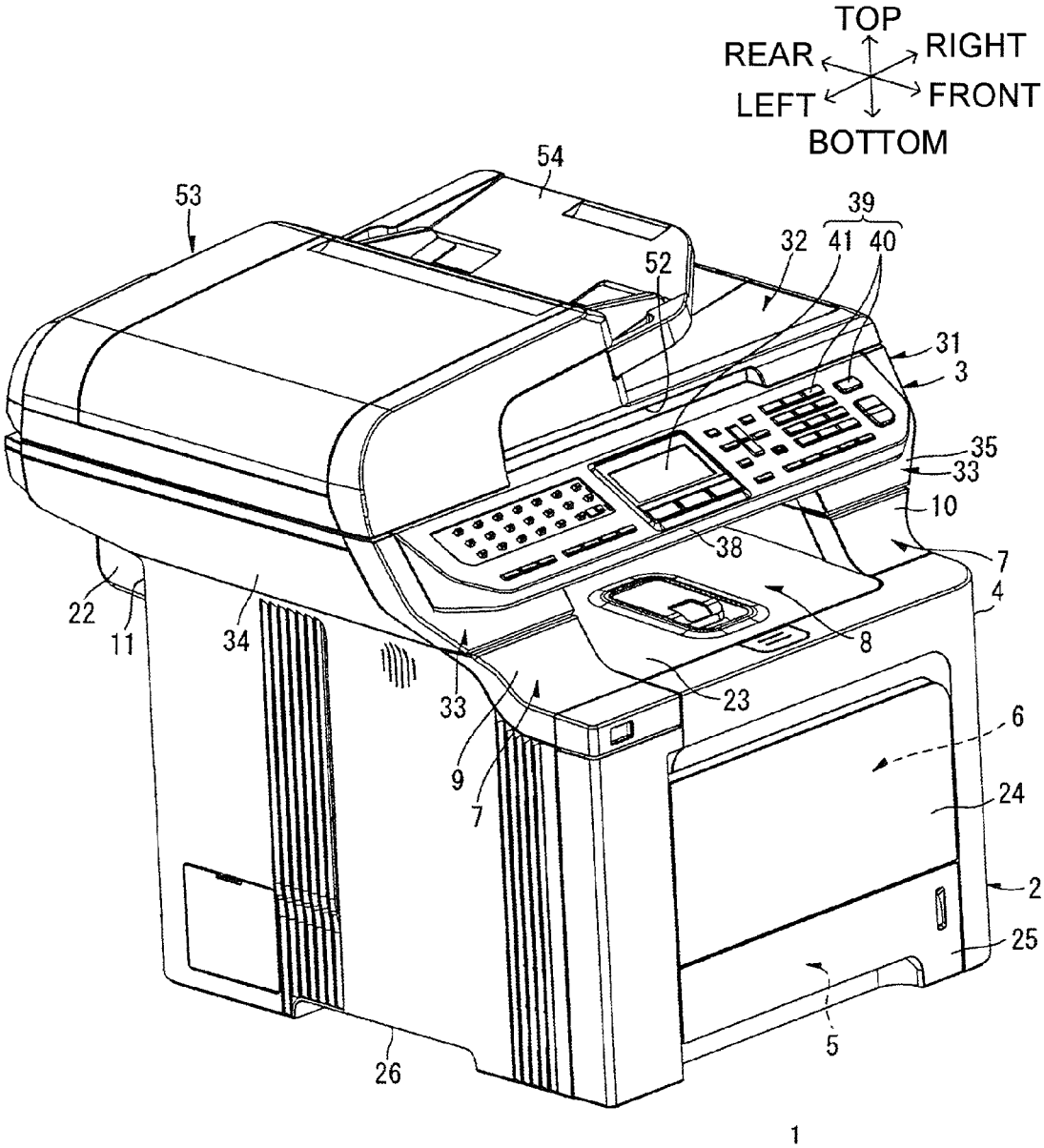
FIG. 1 is a left perspective view of a laser printer viewed from front-top side, according to an illustrative embodiment, in which a scanner unit is in a closed position.

The top or upper side, the bottom or lower side, the left or left side, the right or right side, the front or front side, and the rear or rear side of the laser printer 1 are identified as indicated by arrows in FIG. 1. With regard to various individual objects of the laser printer 1, sides of the individual objects are similarly identified based on the arranged/attached position of the object on/in the laser printer 1 shown in FIG. 1. The top and bottom direction may be referred to as a height direction, and the left and right direction may be referred to as a width direction. The width direction is perpendicular to a direction where a scanner unit 3 is open and closed. The front and rear direction is perpendicular to both the direction where the scanner unit 3 is open and closed and a direction where a left leg portion 34 faces a left protrusion 36 or a right leg portion 35 faces a right protrusion 37.

As shown in FIG. 1, the laser printer 1 is generally rectangular and is slightly vertically long. More specifically, the laser printer 1 is generally T-shaped in a front view. The laser printer 1 is a multifunction apparatus, and includes an image forming unit 2 functioning as an image forming part, and a scanner unit 3 disposed above the image forming unit 2 and functioning as an image reading part. The scanner unit 3 is opened and closed with respect to the image forming unit 2.

The image forming unit 2 is generally box-shaped and is slightly long in the front and rear direction. The image forming unit 2 includes a printer housing 4, a feeder unit 5 disposed in a lower portion of the printer housing 4, and an image forming part 6 disposed in an upper portion of the printer housing 4.

The printer housing 4 is made of a resin, forms an outer fence of the image forming unit 2, and is generally box-shaped and is slightly long in the front and rear direction. More specifically, the front, rear, left, and right surfaces of the printer housing 4 are vertical planes, and the top and bottom surfaces are horizontal planes.

The printer housing 4 includes a leg receiving portion 7 at an upper end of the printer housing 4.

Figure 2:
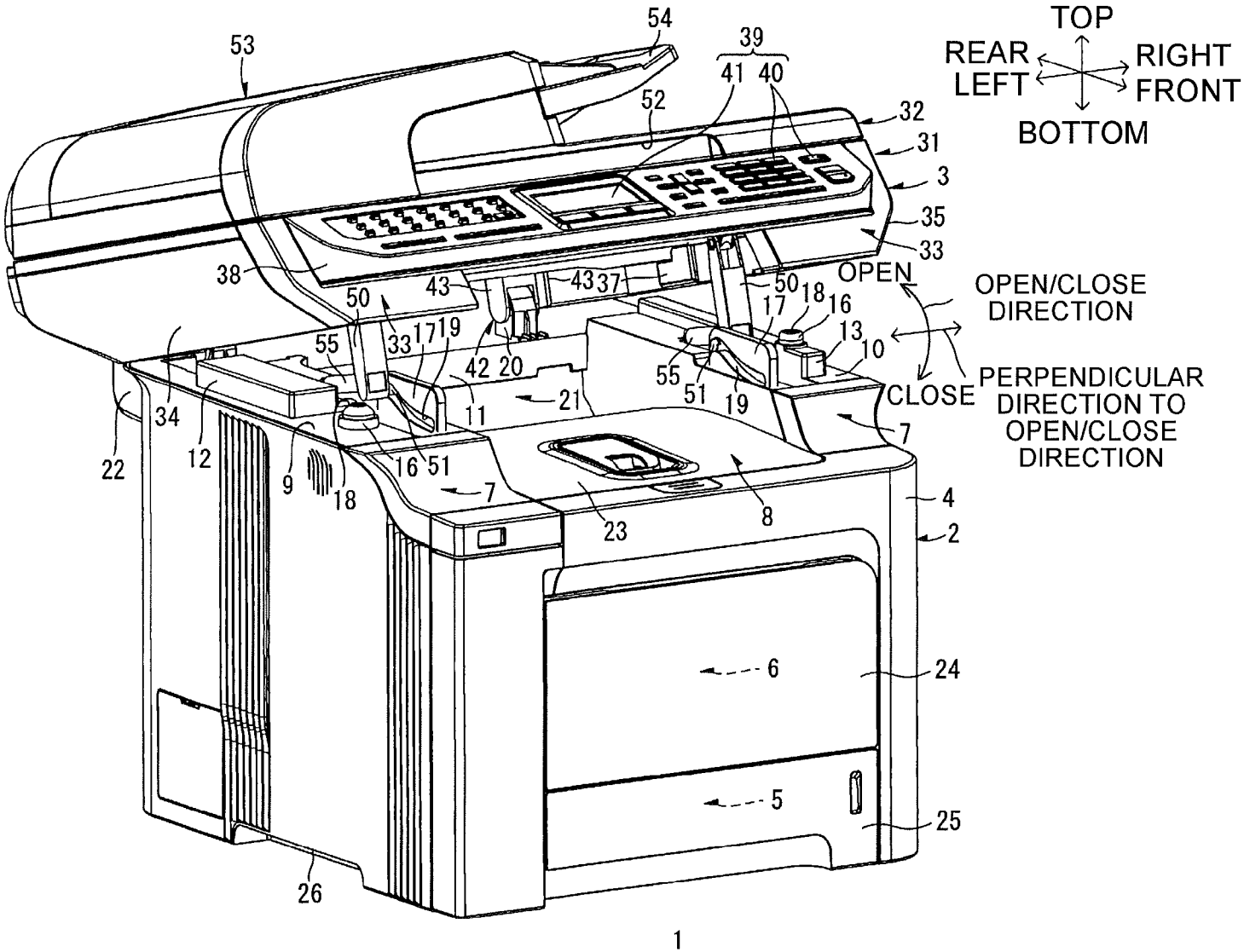
FIG. 2 is a left perspective view of the laser printer of FIG. 1, in which the scanner unit is in an open position.
Figure 3:
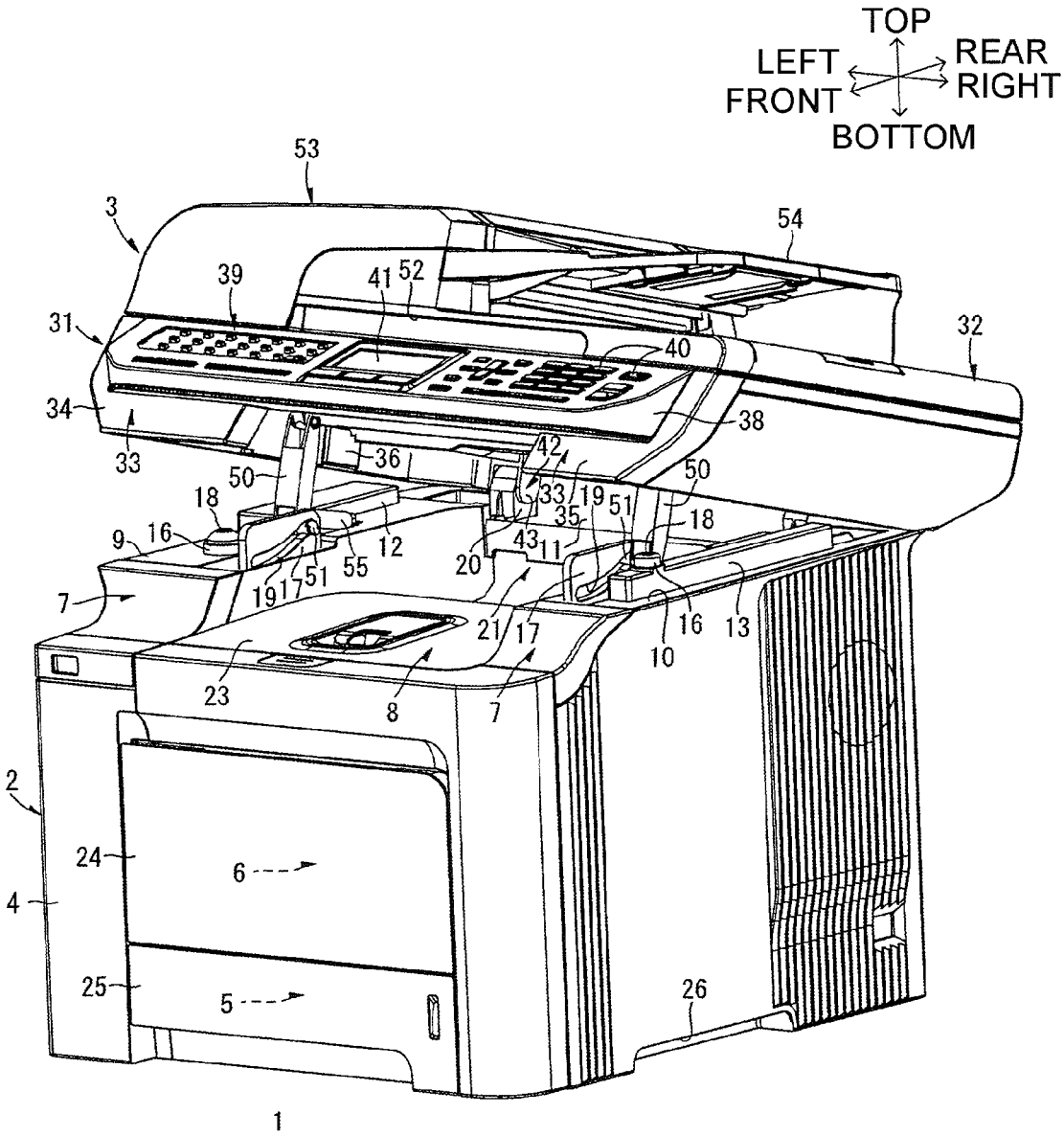
FIG. 3 is a right perspective view of the laser printer of FIG. 1, in which the scanner unit is in the open position.
Figure 5:
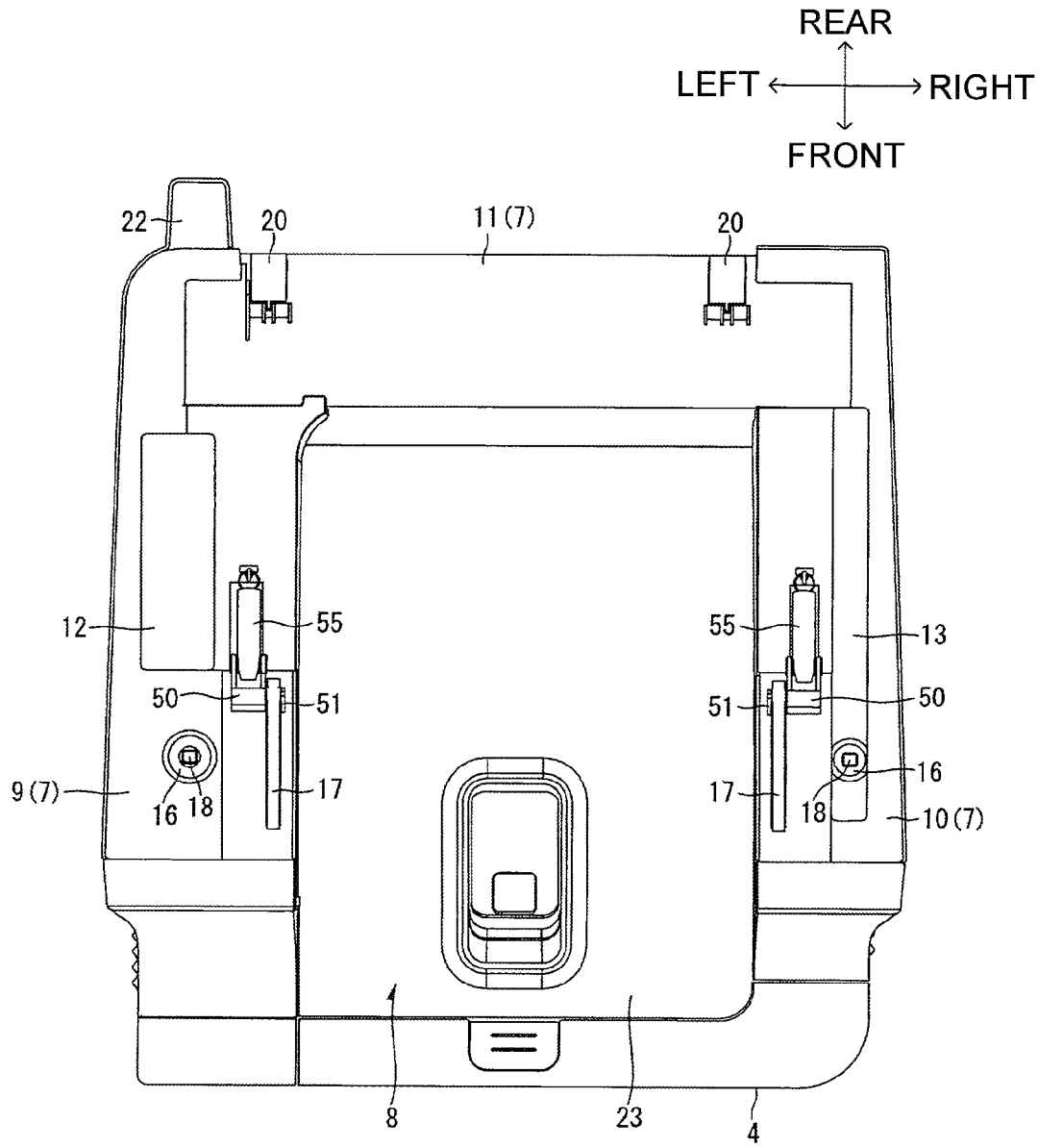
FIG. 5 is a plan view of a printer housing of the laser printer of FIG. 1.

The leg receiving portion 7 is made of a resin and located above the image forming part 6 as shown in FIGS. 2 and 3. The leg receiving portion 7 is formed continuously at a left end, right end, and rear end of the printer housing 4 and protrudes upward from the top surface of the printer housing 4. The leg receiving portion 7 is U-shaped and is recessed rearward in a plan view (FIG. 5). The top surface of the leg receiving portion 7 is a flat surface in the horizontal direction.

The leg receiving portion 7 integrally includes a left leg receiving portion 9 disposed on a left end portion of the printer housing 4, a right leg receiving portion 10 disposed on a right end portion of the printer housing 4, and a rear leg receiving portion 11 disposed on a rear end portion of the printer housing 4.

The left and right leg receiving portions 9, 10 are disposed facing each other to sandwich a sheet ejection portion 8 therebetween. The left and right leg receiving portions 9, 10 are long in the front and rear direction and are generally box-shaped. Front ends of the left and right leg receiving portions 9, 10 are disposed behind a front end of the printer housing 4. Front end surfaces of the left and right leg receiving portions 9, 10 are gently inclined from their upper ends toward their lower ends, and continue to the top surface of the front end of the printer housing 4. As shown in FIG. 1, an outer surface of each of the left and right leg receiving portions 9, 10 is formed so as to gently warp outward in the width direction from its lower end toward its upper end. An inner surface of each of the left and right leg receiving portions 9, 10 is formed as a vertical plane.

The rear leg receiving portion 11 is long in the width direction and is generally box-shaped as shown in FIGS. 2 and 3. A top surface of the rear leg receiving portion 11 is formed at a level lower than a top surface of each of the left and right leg receiving portions 9, 10.

A left storage box 12 and a right storage box 13 are disposed in outward positions on the left and right leg receiving portions 9, 10. The left and right storage boxes 12, 13 each function as a first contact portion of a contacting member configured to reduce damage on printer-side hinges 20 and scanner-side hinges 42 when external force is applied in the width direction.

Figure 4:
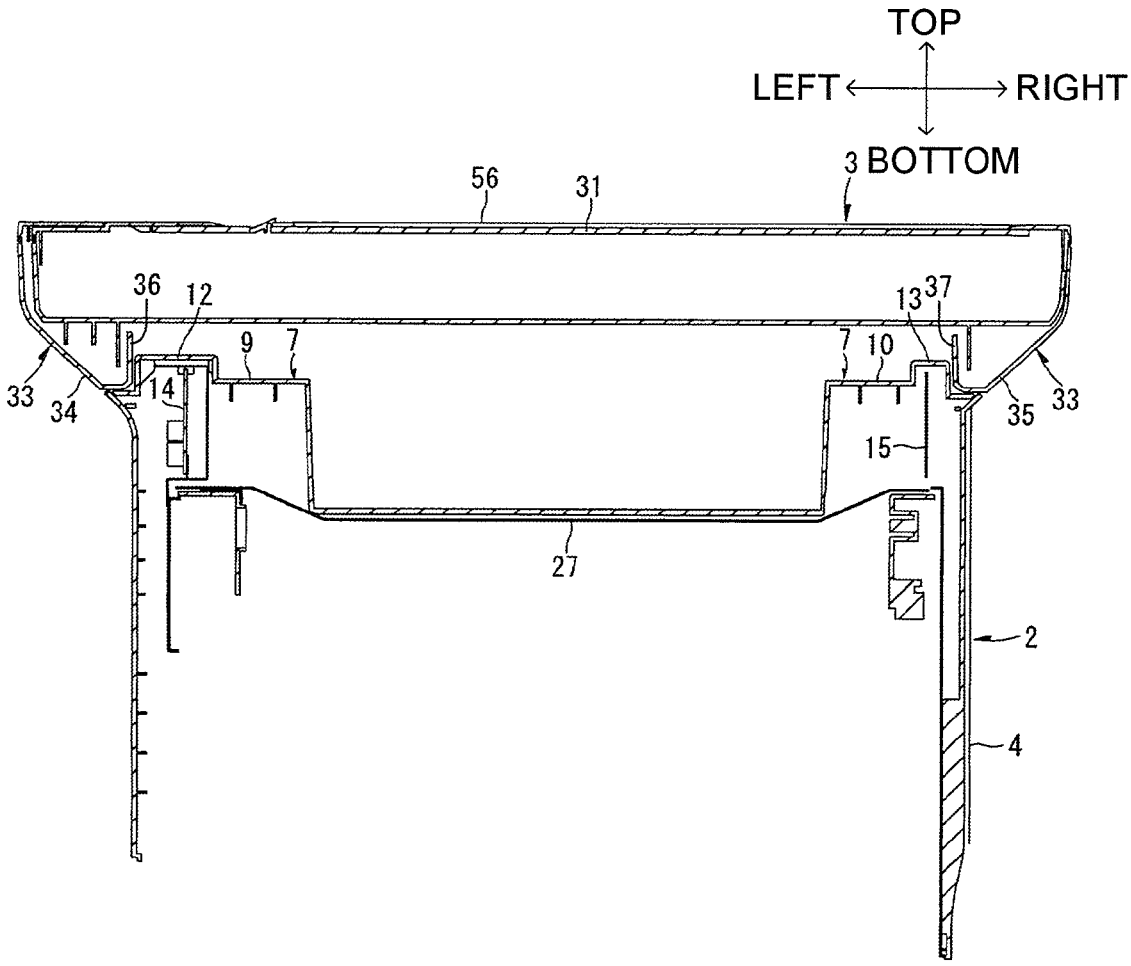
FIG. 4 is a cross-sectional view of the laser printer of FIG. 1.

The left storage box 12 is made of a resin, and disposed rearward of the left leg receiving portion 9. The left storage box 12 is generally rectangular-shaped, in a plan view, and is long in the front-rear direction and broad in the width direction. The left storage box 12 is box-shaped as shown in FIG. 4, in which the left storage box 12 protrudes upward from the top surface of the left leg receiving portion 9 toward a bottom surface of a document base 31. The left storage box 12 is integrally formed with the left leg receiving portion 9, and the left storage box 12 is formed into a hollow body opening downward. As shown in FIG. 4, a component, e.g. a driver board 14 is stored in the left storage box 12. The driver board 14 is configured to control the scanner unit 3. The driver board 14 is shaped in a thin board and is disposed vertically such that an upper end of the driver board 14 is stored in the left storage box 12. The driver board 14 is secured in the printer housing 4, although it is not shown.

The right storage box 13 is made of a resin, and is disposed on the top surface of the right leg receiving portion 10 so as to extend in the front-rear direction, as shown in FIGS. 2 and 3. The right storage box 13 is generally rectangular-shaped, in a plan view, and is long in the front-rear direction, and narrow in the width direction. The right storage box 13 is box-shaped as shown in FIG. 4, in which the right storage box 13 protrudes upward from the top surface of the right leg receiving portion 10 toward the bottom surface of the document base 31. The right storage box 13 is integrally formed with the right leg receiving portion 10, and the right storage box 13 is formed into a hollow body opening downward. As shown in FIG. 4, a component, e.g. a LAN board 15 is stored in the right storage box 13. The LAN board 15 is configured to control wireless LAN. The LAN board 15 is shaped in a thin board and is disposed vertically such that an upper end of the LAN board 15 is stored in the right storage box 13. The LAN board 15 is secured in the printer housing 4, although it is not shown.

The printer housing 4 includes a frame 27, which is a steel plate. The driver board 14 and the LAN board 15 are secured above the frame 27 in the printer housing 4, thereby preventing the frame 27 from generating electromagnetic interference of radio waves, which are to be transmitted to and received by the LAN board 15.

Each of the left and right leg receiving portions 9, 10 is provided, at a front end, with a positioning boss 16 and a damper supporting plate 17, as shown in FIGS. 2 and 3.

The positioning bosses 16 are disposed outside in the width direction at front ends of the left and right leg receiving portions 9, 10. The left positioning boss 16 is disposed in front of the left storage box 12 on the top surface of the left leg receiving portion 9. The left positioning boss 16 is shaped in the form of a generally hollow hemisphere protruding upward. The left positioning boss 16 includes a lock hole 18 at the upper end. The right positioning boss 16 is disposed in front of the right storage box 13 on the top surface of the right leg receiving portion 10. The right positioning boss 16 is shaped in the form of a generally hollow hemisphere protruding upward. The right positioning boss 16 includes a lock hole 18 at the upper end.

The damper supporting plates 17 are disposed in front sides of the left and right receiving portions 9, 10, and inward from the positioning bosses 16 in the width direction. The damper supporting plates 17 are thin in a side view and generally rectangular-shaped. Each of the damper supporting plates 17 includes a guide groove 19. Each guide groove 19 is arc-shaped in a side view, extending in the front and rear direction, and passing through the corresponding damper supporting plate 17 in thickness direction.

Two printer-side hinges 20 are disposed on the top surface of the rear leg receiving portion 11. The printer-side hinges 20 are included in an opening/closing member that is configured to connect the scanner unit 3 and the image forming unit 2 so that the scanner unit 3 is free to open and close with respect to the image forming unit 2.

The printer-side hinges 20 are spaced in the width direction on the top surface of the rear leg receiving portion 11. The printer-side hinges 20 protrude upward from the top surface of the rear leg receiving portion 11. The printer-side hinges 20 are provided with holes (not shown) passing therethrough in the width direction. Pivot shafts 44 are rotatably supported in the holes of the corresponding printer-side hinges 20.

An ejection opening 21 is generally in the form of a rectangle, which is long in the width direction, in a front view, at the front side of the rear leg receiving portion 11. Ejection rollers (not shown) are disposed in the ejection opening 21.

A printer-side harness storing portion 22 is provided at the rear end of the rear leg receiving portion 11. A wire harness (not shown) that connects the image forming unit 2 and the scanner unit 3 is stored in the printer-side harness storing portion 22.

The sheet ejection portion 8 is formed in an upper portion of the printer housing 4. The sheet ejection portion 8 is defined as a space, in a plan view, enclosed by the leg receiving portion 7 which is recessed rearward, and as a space, in a front view, sandwiched between the left and right receiving portions 9, 10 that are disposed facing each other in the width direction. A central top surface of the printer housing 4 exposed by the sheet ejection portion 8 is an ejection tray 23 where ejected recording sheets are received and loaded.

The ejection tray 23 is formed as a curved surface slightly downward recessed from a front end of the central top surface of the printer housing 4 to rear side. The ejection tray 23 continues to the front side of the rear leg receiving portion 11 at its deepest portion or rear end below the ejection opening 21.

A recording sheet on which image has been formed in the image forming part 6 is fed from rear to front by the ejection rollers (not shown) and ejected onto the ejection tray 23 via the ejection opening 21.

Carrying gripping portions 26 are formed at lower ends of the left and right surface of the printer housing 4. The carrying gripping portions 26 are formed by cutting the lower ends of the left and right surfaces of the printer housing 4 in a generally inverse U shape in a side view in a generally central portion in the front and rear direction.

As shown in FIG. 1, a first cover 24 and a second cover 25 are disposed on the front surface of the printer housing 4. The first cover 24 and the second cover 25 are configured to be opened and closed. When the first cover 24 is opened, the image forming part 6 is exposed to the front. When the second cover 25 is opened, the feeder unit 5 is exposed to the front.

The feeder unit 5 is disposed in the lower portion of the printer housing 4, and a stack of recording sheets is stored in the feeder unit 5. In the feeder unit 5, the recording sheets are separated singly and supplied to the image forming part 6. When the second cover 25 is opened to expose the feeder unit 5, another stack of recording sheets is supplied in the feeder unit 5.

The image forming part 6 is disposed above the feeder unit 5 in the printer housing 4. In the image forming part 6, image information is inputted from the scanner unit 3. In the image forming part 6, an image based on the image information is formed onto a recording sheet supplied from the feeder unit 5.

As shown in FIG. 1, the scanner unit 3 is generally box-shaped and is longer than the image forming unit 2 in the width direction. The scanner unit 3 includes a document base 31 and a document holding cover 32 configured to be pivotally supported by the document base 31.

The document base 31 forms a rectangle in a plan view, and is thick. The left and right sides of the document base 31 extend further outward in the width direction than those of the image forming unit 2.

Figure 6:
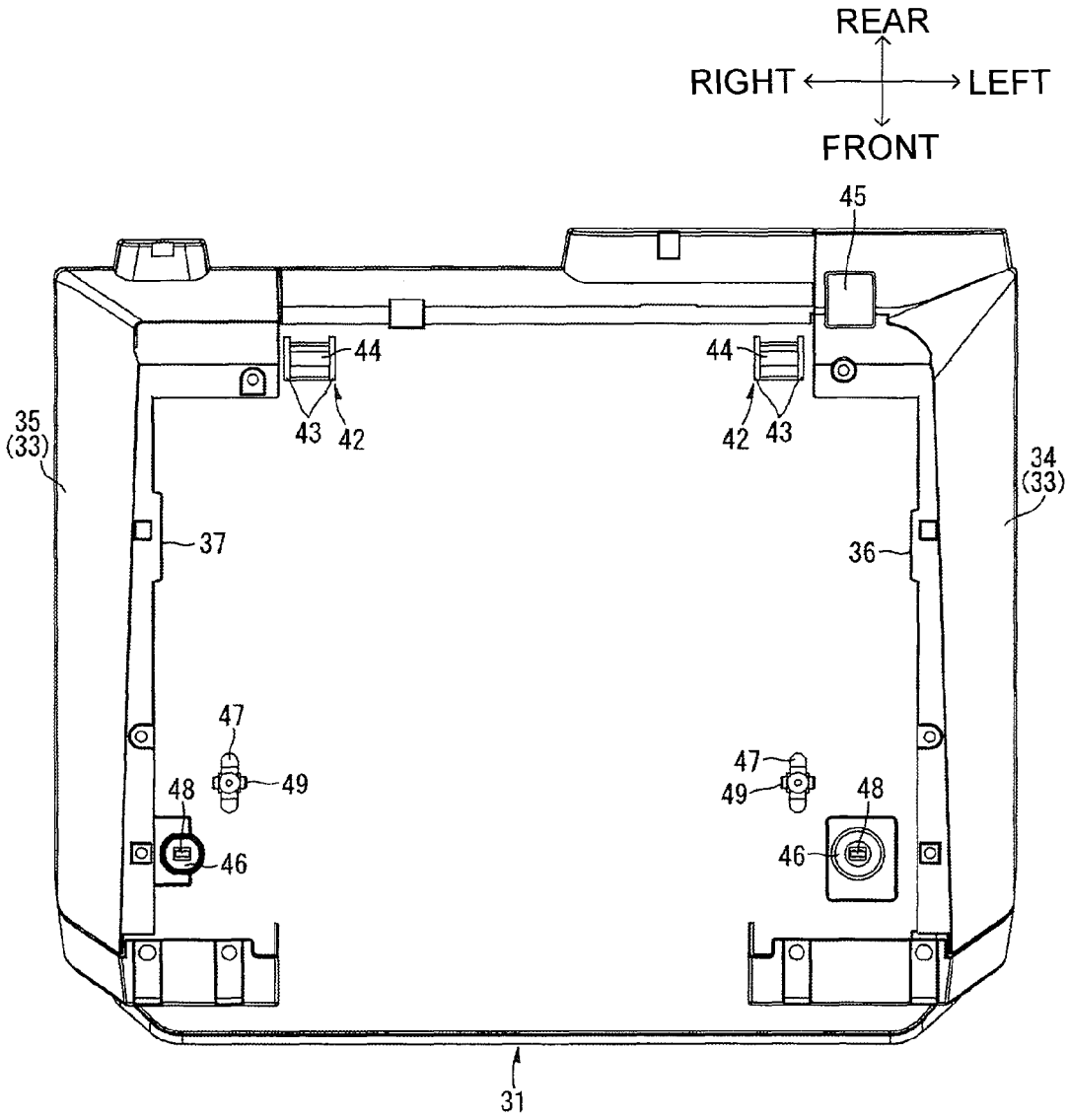
FIG. 6 is a bottom view of a document base of the laser printer of FIG. 1.

As shown in FIG. 6, the document base 31 includes leg portions 33 on the bottom surface.

The leg portions 33 are formed on both the left end and the right end of the document base 31, and protrude downward from the bottom surface of the document base 31. In other words, the leg portions 33 are disposed facing each other to sandwich the bottom surface of the document base 31. The bottom surface of the leg portions 33 is formed as a horizontal flat surface.

The leg portions 33 include a left leg portion 34 and a right leg portion 35. The left leg portion 34 is disposed on the left end of the document base 31, and the right leg portion 35 is disposed on the right end of the document base 31.

The left and right leg portions 34, 35 are disposed facing each other in the width direction to sandwich the sheet ejection portion 8. The left and right leg portions 34, 35 are generally box-shaped and long in the front-rear direction, and, in a plan view, generally U-shaped and opening inward in the width direction.

Each front end of the left and right leg portions 34, 35 is curved inward in the width direction with respect to a central portion thereof in the front-rear direction. Each front end of the left and right leg portions 34, 35 inclines forward from its upper end toward its lower end, and continues to a corresponding front end of the left and right leg receiving portions 9, 10 (see FIG. 1).

Each rear end of the left and right leg portions 34, 35 gradually narrows inward in the width direction with respect to the central portion thereof in the front-rear direction. Each rear end surface of the left and right leg portions 34, 35 inclines frontward from its upper end toward its lower end, and continues to a rear end of the rear leg receiving portion 11.

Each outer surface of the left and right leg portions 34, 35 in the width direction inclines smoothly inward from its upper end to its lower end, and continues to a corresponding outer surface of the left and right leg receiving portions 9, 10 (see FIG. 1). Each inner surface of the left and right leg portions 34, 35 is formed as a vertical flat surface. The inner surfaces of the left and right leg portions 34, 35 face the left and right storage boxes 12, 13, respectively, when the scanner unit 3 is closed, as shown in FIG. 7.

The inner surfaces of the left and right leg portions 34, 35 are provided with protrusions 36, 37, functioning as a second contact portion of the contact member.

The left protrusion 36 is disposed slightly rearward on the inner surface of the left leg portion 34. The left protrusion 36 is generally rectangular in a side view as shown in FIG. 3, and protrudes from the inner surface of the left leg portion 34 toward the inside (or the right protrusion 37), flatly in a bottom view.

Figure 7:
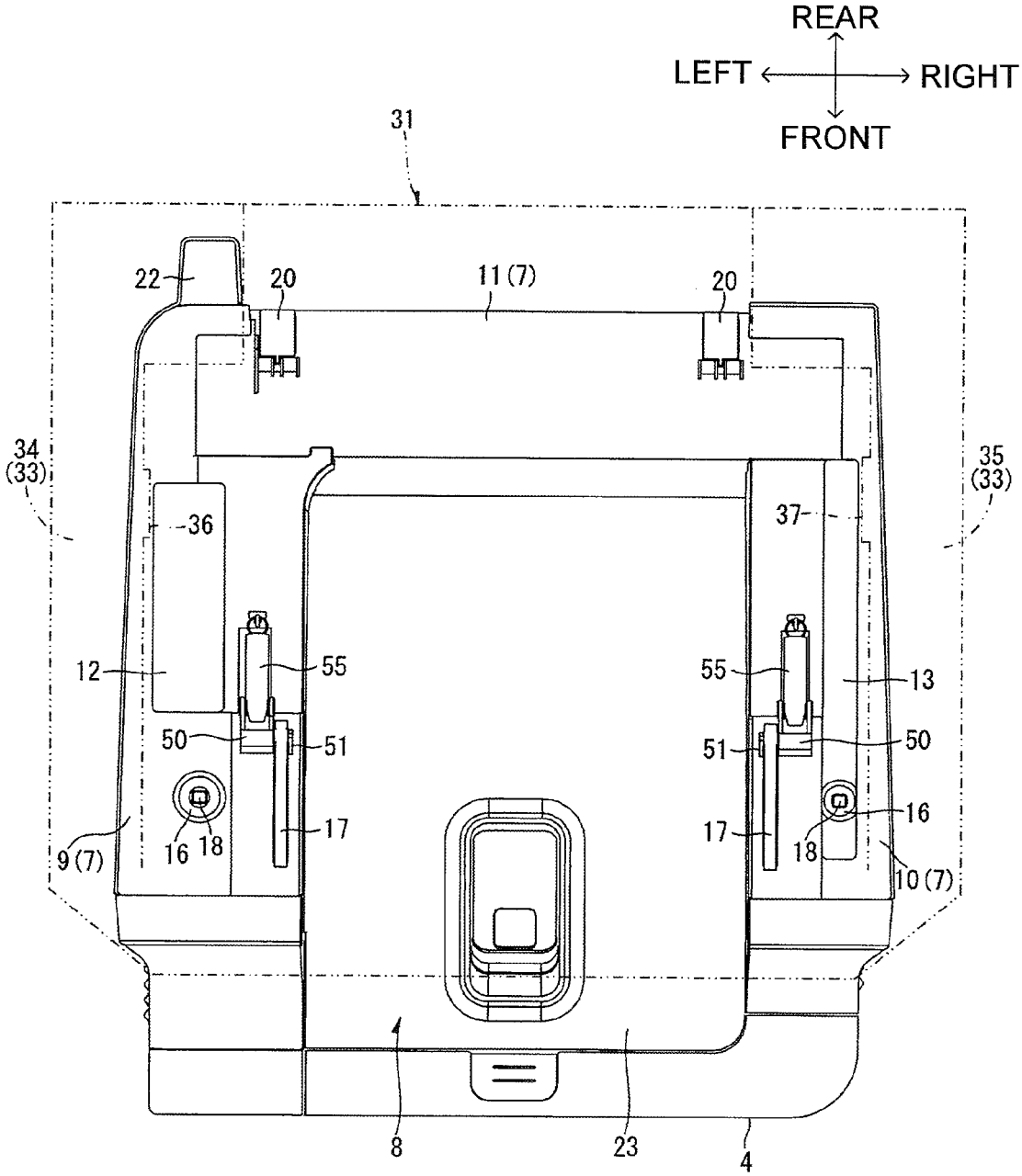
FIG. 7 is a plan view of a relative arrangement of the printer housing and the document base when no external force is applied.

As shown in FIG. 7, when the scanner unit 3 is closed, the left protrusion 36 and the left storage box 12 are disposed in spaced apart facing relation.

Specifically, a right side of the left protrusion 36 is formed flat, and a spacing between the right side of the left protrusion 36 and the left side of the left storage box 12 is set narrower than a spacing between the inner surface of the left leg portion 34 and the left side of the left storage box 12. The spacing between the left protrusion 36 and the left storage box 12 is set to approximately 1.5 mm. The left protrusion 36 faces the rear end of the left storage box 12, such that the rear end of the left protrusion 36 is located rearward more than the rear end of the left storage box 12.

The right protrusion 37 is disposed slightly rearward on the inner surface of the right leg portion 35 so as to face the left protrusion 36 in the width direction, as shown in FIG. 6. The right protrusion 37 is generally rectangular in a side view as shown in FIG. 2, and is longer than the left protrusion 36. The right protrusion 37 protrudes from the inner surface of the right leg portion 35 toward the inside (or the left protrusion 36), flatly in a bottom view.

As shown in FIG. 7, when the scanner unit 3 is closed, the right protrusion 37 and the right storage box 13 are disposed in spaced apart facing relation.

Specifically, a left side of the right protrusion 37 is formed flat, and a spacing between the left side of the right protrusion 37 and the right side of the right storage box 13 is set narrower than a spacing between the inner surface of the right leg portion 35 and the right side of the right storage box 13. The spacing between the right protrusion 37 and the right storage box 13 is set to approximately 1.5 mm. The right protrusion 37 faces the rear end of the right storage box 13 in all area from the front end to the rear end.

As shown in FIG. 1, the document base 31 includes, at the front end, a gripping portion 38 for closing and opening the document base 31. The gripping portion 38 protrudes frontward horizontally from the document base 31, and is formed long in the width direction having a generally triangular shape in a side view. Specifically, the gripping portion 38 is disposed above and extends between the left and right leg portions 34, 35. The top surface of the gripping portion 38 extends from the front end of the document base 31 obliquely downward toward the front. The bottom surface of the gripping portion 38 extends horizontally frontward from the lower end of the front end of the document base 31, and continues to the front end of the top surface of the gripping portion 38.

An operation part 39 is disposed on the top surface of the gripping portion 38. The operation part 39 includes operation buttons 40 and a display screen 41. A user inputs an operation to the laser printer via the operation buttons 40, and an operation status of the laser printer 1 is displayed on the display screen 31.

Two scanner-side hinges 42 are disposed on the bottom surface of the rear end of the document base 31, as shown in FIG. 6. The scanner-side hinges 42 are disposed facing each other in the width direction inside more than the rear ends of the left and right leg portions 34, 35.

The scanner-side hinges 42 are spaced apart in the width direction on the bottom surface of the document base 31 so as to face the printer-side hinges 20 vertically. Each of the scanner-side hinges 42 includes a pair of oscillating plates 43 protruding downward from the bottom surface of the document base 31 and a pivot shaft 44 extended between the oscillating plates 43. The pair of oscillating plates 43 is disposed facing each other at such a distance as to sandwich the printer-side hinge 20 in the width direction as shown in FIGS. 2 and 3. The pivot shaft 44 is inserted into holes of the corresponding printer-side hinge 20, such as to be rotatably supported by the printer-side hinge 20.

Thus, the printer-side hinges 20 and the scanner-side hinges 42 are disposed between the image forming unit 2 and the scanner unit 3, such that the scanner unit 3 is movably coupled to the image forming unit 2.

As shown in FIG. 6, a scanner-side harness storing portion 45 is provided at the rear end of the document base 31. A wire harness (not shown) that connects the image forming unit 2 and the scanner unit 3 is stored in the scanner-side harness storing portion 45.

Two positioning recessed portions 46 and two damper rotation supporting portions 47 are disposed at the front side of the bottom surface of the document base 31.

The positioning recessed portions 46 are spaced away from each other in the width direction so as to face the corresponding positioning bosses 16 vertically. The positioning recessed portions 46 are disposed inside in the width direction more than the left and right leg portions 34, 35 and slightly rearward from the front ends of the left and right leg portions 34, 35.

Each positioning recessed portions 46 has a size capable of storing the corresponding positioning boss 16, and is recessed upward from the bottom surface of the document base 31. Each positioning recessed portion 46 is provided with a positioning protrusion 48 protruding downward from the deepest portion (or the upper end) of the corresponding positioning portion 46. Each positioning protrusion 48 is formed slightly greater in size than the lock hole 18 of the positioning boss 16.

The damper rotation supporting portions 47 are spaced away from each other in the width direction on the bottom surface of the document base 31 so as to face the corresponding damper supporting plates 17 vertically. The damper rotation supporting portions 47 are disposed inside in the width direction more than the positioning recessed portions 46 and obliquely rearward from the positioning recessed portions 46. The damper rotation supporting portions 47 protrude downward from the bottom surface of the document base 31 and rotatably support damper shafts 49 which are inserted in the width direction.

Two dampers 50 are disposed between the image forming unit 2 and the scanner unit 3. The dampers 50 function as an opening degree setting member configured to set a degree of opening of the scanner unit 3 with respect to the image forming unit 2. The dampers 50 are spaced away from each other in the width direction to sandwich the sheet ejection portion 8 as shown in FIGS. 2 and 3. The dampers 50 are connected at their upper ends to the damper rotation supporting portions 47 and at their lower ends to the damper supporting plates 17.

Specifically, the dampers 50 are generally rectangular-shaped and long in the vertical direction. The damper shafts 49 of the damper rotation supporting portions 47 are rotatably inserted into the upper ends of the corresponding dampers 50. The dampers 50 include, at their lower ends, engaging portions 51 protruding inward in the width direction. The engaging portions 51 are slidably mounted in the guide grooves 19 of the damper supporting plates 17.

The dampers 50 are connected to springs 55, e.g. tension coil springs, at their lower ends. One end of the spring 55 is connected to the corresponding damper 50 and the other end is connected to the top surface of the left or right leg receiving portion 9, 10. Thus, the lower ends of the dampers 50 are normally urged rearward by the springs 55.

The dampers 50 are oscillated at their upper ends on the damper shafts 49 and slide along the guide grooves 19 in the front-rear direction at their lower ends by opening and closing of the scanner unit 3 with respect to the image forming unit 2. When the scanner unit 3 is opened with respect to the image forming unit 2, the engaging portions 51 contact the rear ends of the corresponding guide grooves 19, thereby controlling the degree of opening of the scanner unit 3.

The document base 31 is provided with a glass surface 56 (FIG. 4) on the top surface. A document is placed on the glass surface 56. The document base 31 includes inside a CCD sensor (not shown) for reading image information of a document, and a main-scanning motor (not shown) for scanning the CCD sensor as opposed to the glass surface 56. The document placed on the glass surface 56 is read as image information and the image information is outputted to the image forming part 6.

As shown in FIG. 1, the document holding cover 32 is thin, and is generally rectangular-shaped in a plan view. A bottom surface of the document holding cover 32 is formed generally equal in shape to that of the document base 31. The document holding cover 32 is pivotally supported to the document base 31 at the rear end via a hinge (not shown).

A cover gripping portion 52 is provided at a generally central portion of the front end of the document holding cover 32. The cover gripping portion 52 is recessed rearward. The document holding cover 32 is vertically pivoted on the rear end by holding the cover gripping portion 52. The document holding cover 32 is pivotal between a position to cover the glass surface 56 of the document base 31 and a position to expose the glass surface 56. When image information of a document placed on the glass surface 56 is read, the glass surface 56 of the document base 31 is covered. The glass surface 56 of the document base 31 is opened when the document is placed or removed.

An auto document feeder (ADF) 53 is disposed in a left half portion on the top surface of the document holding cover 32. The ADF 53 is configured to automatically read image information of a document. A document feed roller (not shown), a document feed motor (not shown), and a document detecting sensor (not shown) are built in the ADF 53.

A document tray 54 is disposed on the right side of the ADF 53. Documents are set in stack on the document tray 54.

A document intake (not shown) for introducing a document inside the ADF 53 is formed on the right side of the ADF 53 and above the document tray 54. A document outlet (not shown) for ejecting the document from the ADF 53 is formed on the right side of the ADF 53 and below the document tray 54.

The scanner unit 3 has two modes to read or scan image information of a document: a normal mode and auto mode.

When image information of a document is read in the normal mode, the cover gripping portion 52 is held, the document holding cover 32 is pivoted upward, and the glass surface 56 of the document base 31 is opened. A document is placed on the glass surface 56, the document holding cover 32 is pivoted down to cover the glass surface 56 of the document base 31.

When one of the operation buttons 40 is pressed in the operation part 39, the main-scanning motor is driven. The driving force of the main-scanning motor causes the CCD sensor to scan from the left to the right, for example, to read image information of the document while facing the document placed on the glass surface 56.

When reading of the image information of the document is completed, the glass surface 56 of the document base 31 is opened again to remove the document from the glass surface 56.

In the auto mode, some documents are set on the document tray 54. The document detecting sensor detects that the documents are set on the document tray 54, and the CCD sensor is fixed in an auto document reading position (not shown). When one of the operation buttons 40 is pressed in the operation part 39, the document feed motor is driven. By a driving force of the document feed motor, the document feed roller is rotated, and the documents are sequentially introduced into the ADF 53 via the document intake by the document feed roller. When each document faces the CCD sensor, image information of the document is read by the CCD sensor. The document of which image information has been read is ejected from the document outlet, and loaded onto the top surface of the document holding cover 32.

When the gripping portion 38 is held to open the scanner unit with respect to the image forming unit 2, the front end of the scanner unit 3 is pivoted upward on the printer-side hinges 20 and the scanner-side hinges 42 disposed at the rear end, as shown in FIGS. 2 and 3.

The leg portions 33 of the scanner unit 3 are separated from the leg receiving portions 7 of the image forming unit 2. Specifically, the left leg portion 34 is separated from the left leg receiving portion 9, and the right leg portion 35 is separated from the right leg receiving portion 10.

At this time, the scanner unit 3 can be easily opened by the urging force of the springs 55 against the dampers 50.

When the engaging portions 51 of the dampers 50 contact the rear ends of the guide grooves 19, the degree of opening of the scanner unit 3 with respect to the image forming unit 2 is kept.

Thus, the scanner unit 3 is located in the open position, and the sheet ejection portion 8 disposed between the image forming unit 2 and the scanner unit 3 is exposed upward. Recording sheets ejected to the sheet ejection portion 8 can be easily taken out.

The open position of the scanner unit 3 is maintained by the urging force of the springs 55 against the dampers 50.

When the gripping portion 38 is held to close the scanner unit 3 with respect to the image forming unit 2, the front end of the scanner unit 3 is pivoted downward on the printer-side hinges 20 and the scanner-side hinges 42 disposed at the rear end. The engaging portions 51 of the dampers 50 slide frontward along the guide grooves 19, and the leg portions 33 of the scanner unit 3 contact the leg receiving portions 7 of the image forming unit 2. Specifically, the left leg portion 34 contacts the left leg receiving portion 9 and the right leg portion 35 contacts the right leg receiving portion 10.

As the scanner unit 3 is closed, the springs 55 stretch out, and the urging forces of the springs 55 against the dampers 50 increase. Thus, the scanner unit 3 can be smoothly closed.

In this manner, the scanner unit 3 is located in the closed position, and the sheet ejection portion 8 is covered by the scanner unit 3. The document base 31 is disposed generally horizontally.

When the scanner unit 3 is located in the closed position, the left protrusion 36 is arranged facing the rear end of the left storage box 12 slightly apart in the width direction. In addition, the right protrusion 37 is arranged facing the rear end of the right storage box 13 slightly apart in the width direction.

While the positioning bosses 16 of the left and right leg receiving portions 9, 10 are inserted into the corresponding positioning recessed portions 46, the positioning protrusions 48 of the positioning recessed portions 46 are pressed into the corresponding positioning bosses 16 through the lock holes 18. Thus, the scanner unit 3 is locked in the closed position. This lock minimizes unnecessary oscillation of the scanner unit 3 when the document holding cover 32 is vertically pivoted. When the gripping portion 38 is held to open the scanner unit 3, external force is applied upward, and the positioning protrusions 48 are removed from the positioning bosses 16.

In the laser printer 1, when the scanner unit 3 is in the closed position and external force is not applied in the width direction as shown in FIG. 7, the left protrusion 36 is disposed facing the rear end of the left storage box 12 slightly apart in the width direction. Simultaneously, the right protrusion 37 is disposed facing the rear end of the right storage box 13 slightly apart in the width direction. Thus, the scanner unit 3 can be smoothly opened with respect to the image forming unit 2.

Figure 8:
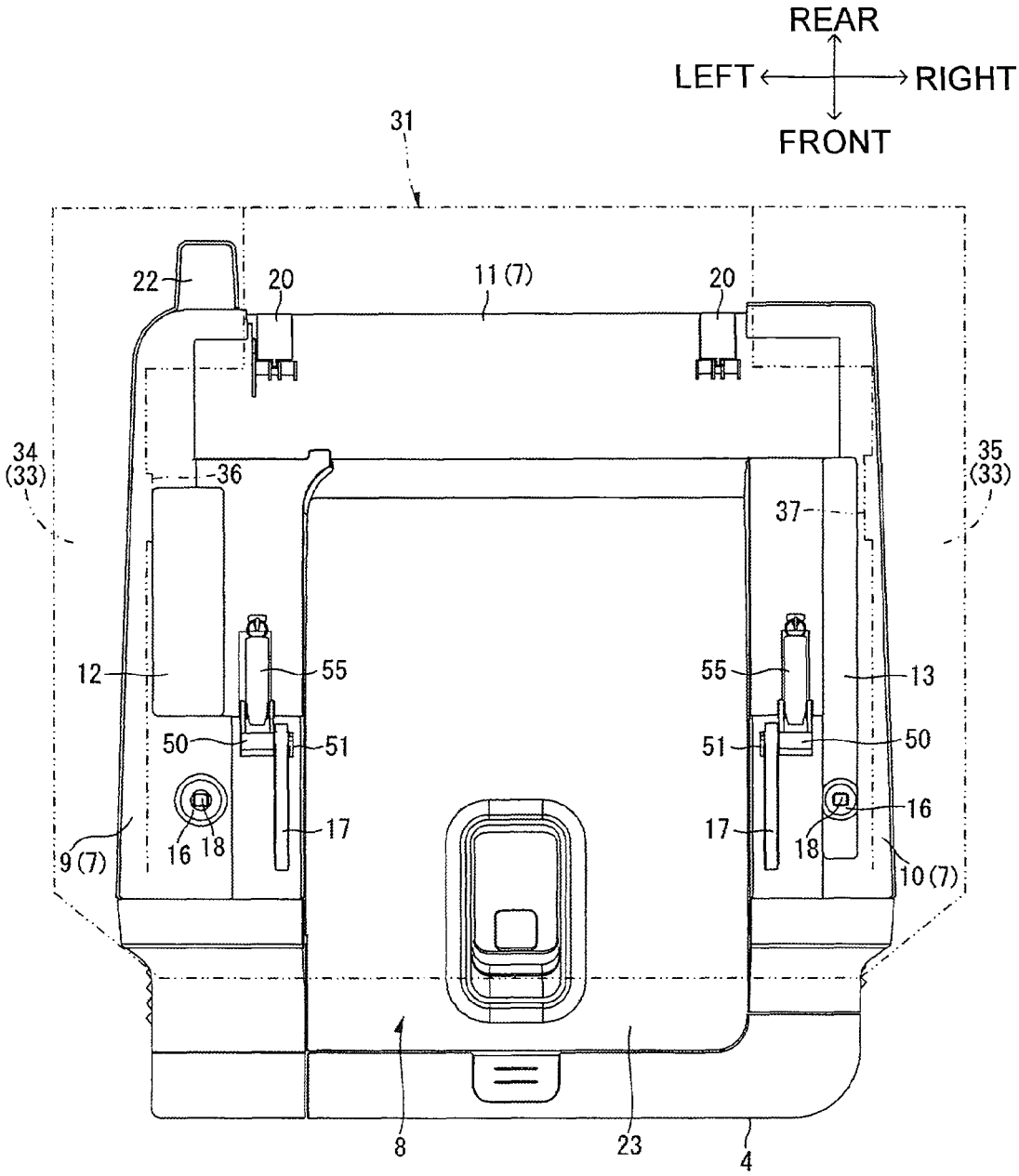
FIG. 8 is a plan view of the relative arrangement of the printer housing and the document base when external force is applied.

When external force is applied in the width direction, for example, when external force is applied to the scanner unit 3 from left to right as shown in FIG. 8, the scanner unit 3 moves to the right relatively to the image forming unit 2 and the left protrusion 36 contacts the rear end of the left storage box 12. With this contact, the scanner unit 3 is prevented from moving further rightward relatively to the image forming unit 2. As a result, deformation of the printer-side hinges 20 and the scanner-side hinges 42 can be prevented.

In other words, the left protrusion 36 and the right protrusion 37 are spaced apart at such a distance as to contact the left storage box 12 and the right storage box 13 respectively before the printer-side hinges 20 and the scanner-side hinges 42 are deformed permanently, when external force is applied in the width direction in the laser printer 1. However, this arrangement allows such deformation that the printer-side hinges 20 and the scanner-side hinges 42 can be restored to their original states by removal of external force.

Thus, even when external force is applied in the width direction in the laser printer 1, the left storage box 12 and the left protrusion 36, and the right storage box 13 and the right protrusion 37 can effectively prevent damage to the printer-side hinges 20 and the scanner-side hinges 42.

In the laser printer 1, the left storage box 12 and the left protrusion 36 are disposed on the left, and the right storage box 13 and the right protrusion 37 are disposed on the right. Thus, when external force is applied from the left to the right, the left protrusion 36 contacts the left storage box 12, thereby preventing damage to the printer-side hinges 20 and the scanner-side hinges 42. When external force is applied from the right to the left, the right protrusion 37 contacts the right storage box 13, thus preventing damage to the printer-side hinges 20 and the scanner-side hinges 42. As a result, even if external force is applied from the left or right, damage to the printer-side hinges 20 and the scanner-side hinges 42 can be prevented.

The left storage box 12 is disposed protruding upward from the top surface of the left leg receiving portion 9 toward the bottom surface of the document base 31. The right storage box 13 is disposed protruding upward from the top surface of the right leg receiving portion 10 toward the bottom surface of the document base 31. Thus, the left and right storage boxes 12, 13 can be reliably brought into contact with the left and right protrusions 36, 37, respectively. As a result, even if external force is applied in the width direction, damage to the printer-side hinges 20 and the scanner-side hinges 42 can be prevented.

Specifically, if external force is applied in the width direction, the left storage box 12 protruding upward from the top surface of the left leg receiving portion 9 contacts the left protrusion 36 protruding upward from the inner side of the left leg portion 34 or the right storage box 13 protruding from the top surface of the right leg receiving portion 10 contacts the right protrusion 37 protruding from the inner surface of the right leg portion 35. Thus, damage to the printer-side hinges 20 and the scanner-side hinges 42 can be prevented.

More specifically, if external force is applied in the width direction, the right side of the left protrusion 36 contacts the left side of the rear end of the left storage box 12 or the left side of the right protrusion 37 contacts the right side of the rear end of the right storage box 13. Sidewalls of the rear ends of the left and right storage boxes 12, 13 may be thickened more than central portions thereof in the front-rear direction. Alternatively, reinforcing ribs may be provided inside the rear ends of the left and right storage boxes 12, 13. Thus, the rear ends of the left and right storage boxes 12, 13 can reliably receive the left and right protrusions 36, 37, respectively. As a result, damage to the printer-side hinges 20 and the scanner-side hinges 42 can be prevented.

The left storage box 12 is formed in a hollow body and stores the driver board 14 therein. The right storage box 13 is also formed in a hollow body and stores the LAN board 15 therein. Thus, neat appearance is achieved.

In the laser printer 1, the degree of opening of the scanner unit 3 with respect to the image forming unit 2 is appropriately adjusted by the dampers 50. As the dampers 50 are disposed inside more than the left and right storage boxes 12, 13 in the width direction, the left and right storage boxes 12, 13 prevent the dampers 50 from receiving external force in the width direction.

In the laser printer 1, the sheet ejection portion 8 is disposed between the image forming unit 2 and the scanner unit 3, so that recording sheets can be ejected within the laser printer 1. The sheet ejection portion 8 is also disposed between the left and right storage boxes 12, 13 that are spaced in the width direction. Even when external force is applied in the width direction, damage to the printer-side hinges 20 and the scanner-side hinges 42 that are disposed in the rear of the sheet ejection portion 8 can be prevented.

The laser printer 1 is designed such that the scanner unit 3 protrudes in the width direction more than the image forming unit 2. Thus, the scanner unit 3 tends to move easily under external force relatively to the image forming unit 2. However, such relative movement can be effectively prevented by contact between the left protrusion 36 and the left storage box 12 or between the right protrusion 37 and the right storage box 13. Thus, damage to the printer-side hinges 20 and the scanner-side hinges 42 can be prevented.

While the features herein have been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image forming unit configured to form an image on a recording sheet;

an image reading unit disposed above the image forming unit and configured to read image information of a document;

an opening/closing member configured to join the image reading unit and the image forming unit together such that the image reading unit is free to open and close with respect to the image forming unit in a first direction; and a contacting member including:

a first contacting member disposed in the image forming unit; and a second contacting member disposed in the image reading unit, wherein when the image reading unit is closed the first and second contacting members are disposed to face each other in a second direction, and are configured to contact each other in the second direction perpendicular to the first direction in response to an external force being applied in the second direction;

another contacting member including another first contacting member and another second contacting member, wherein the contacting member and the another contacting member are spaced apart in the second direction; and a damper disposed to extend between and be attached to each of the image forming unit and the image reading unit, the damper being spaced apart from each of the first and second contacting members in the second direction when the image reading unit is closed, wherein the damper is further inside in the second direction than each of the contacting member and the another contacting member, and configured to set a degree of opening of the image reading unit with respect to the image forming unit.

2. The image forming apparatus according to claim 1, wherein the first contacting members protrude upward from the image forming unit.

3. The image forming apparatus according to claim 2, wherein each first contacting member comprises a hollow space.

4. The image forming apparatus according to claim 3, wherein the image reading unit includes inner surfaces facing the corresponding first contact members in the second direction, and the second contacting members are formed to protrude from the inner surfaces toward the corresponding first contacting members when the image reading unit is closed.

5. The image forming apparatus according to claim 4, wherein each second contacting member is disposed at such a position as to contact an end of the corresponding first contacting member with respect to a direction perpendicular to both the first direction and the second direction.

6. The image forming apparatus according to claim 1, further comprising an ejection part disposed between the image forming unit and the image reading unit and between the contacting member and the another contacting member, the ejection part configured to receive a recording sheet on which an image is formed.

7. The image forming apparatus according to claim 1, wherein the damper is disposed to extend between and be attached to each of the image forming unit and the image reading unit when the image reading unit is both in an opened position and closed position in the first direction.

8. The image forming apparatus according to claim 7, wherein the damper has a degree of freedom relative to the image reading unit when the image reading unit moves between the opened position and the closed position.

9. The image forming apparatus according to claim 7, wherein the damper is configured to move along a surface of the image forming unit when the image reading unit moves between the opened position and the closed position.

10. An image forming apparatus comprising:

an image forming unit configured to form an image on a recording sheet;

an image reading unit disposed above the image forming unit and configured to read image information of a document;

an opening/closing member configured to join the image reading unit and the image forming unit together such that the image reading unit is free to open and close with respect to the image forming unit in a first direction; and a contacting member including:

a first contacting member disposed in the image forming unit; and a second contacting member disposed in the image reading unit, wherein when the image reading unit is closed the first and second contacting members are disposed to face each other in a second direction, and are configured to contact each other in the second direction perpendicular to the first direction in response to an external force being applied in the second direction, and wherein the first contacting member is generally box-shaped.

11. The image forming apparatus according to claim 10, further comprising another contacting member including another first contacting member and second contacting member, wherein the contacting member and the another contacting member are spaced apart in the second direction.

12. The image forming apparatus according to claim 10, wherein the image reading unit protrudes more than the image forming unit in the second direction.

13. The image forming apparatus of claim 10, wherein the image forming unit and the image reading unit are pivotally connected such that the image reading unit is free to open and close with respect to the image forming unit in the first direction.

14. The image forming apparatus of claim 10, wherein the opening/closing member includes a hinge.

15. An image forming apparatus comprising:

an image forming unit configured to form an image on a recording sheet;

an image reading unit disposed above the image forming unit and configured to read image information of a document;

an opening/closing member configured to join the image reading unit and the image forming unit together such that the image reading unit is free to open and close with respect to the image forming unit in a first direction; and a contacting member including:

a first contacting member disposed in the image forming unit; and a second contacting member disposed in the image reading unit, wherein when the image reading unit is closed the first and second contacting members are disposed to face each other in a second direction, and are configured to contact each other in the second direction perpendicular to the first direction in response to an external force being applied in the second direction, and wherein the first contacting member provides storage for an electrical component.

16. The image forming apparatus according to claim 15, wherein the first contacting member is generally box-shaped.

17. The image forming apparatus according to claim 15, wherein the electrical component includes a circuit board.

18. The image forming apparatus according to claim 15, wherein the electrical component includes a driver board or a LAN board.

* * * * *